US012180662B2

(12) United States Patent
Ustach et al.

(10) Patent No.: US 12,180,662 B2
(45) Date of Patent: Dec. 31, 2024

(54) POST ASSEMBLY WITH IMPACT ABSORBING CORE MECHANISM

(71) Applicant: McCue Corporation, Danvers, MA (US)

(72) Inventors: Thomas Ustach, Boston, MA (US); Teodoro A. Mesa, Lynn, MA (US); Matthew O'Brien, Gresham, OR (US)

(73) Assignee: McCue Corporation, Danvers, MA (US)

( * ) Notice: Subject to any disclaimer, the term of this patent is extended or adjusted under 35 U.S.C. 154(b) by 124 days.

(21) Appl. No.: 17/953,631

(22) Filed: Sep. 27, 2022

(65) Prior Publication Data

US 2023/0097881 A1 Mar. 30, 2023

Related U.S. Application Data

(60) Provisional application No. 63/249,134, filed on Sep. 28, 2021.

(51) Int. Cl.
*E01F 9/627* (2016.01)
*E04H 12/22* (2006.01)

(52) U.S. Cl.
CPC ..... *E01F 9/629* (2016.02); *E04H 12/2276* (2013.01)

(58) Field of Classification Search
CPC ..... E01F 9/629; E01F 15/003; E04H 12/2276
See application file for complete search history.

(56) References Cited

U.S. PATENT DOCUMENTS

| | | | | |
|---|---|---|---|---|
| 2007/0053743 | A1* | 3/2007 | Clark | E01F 9/629 404/10 |
| 2013/0022396 | A1* | 1/2013 | Hannah | E01F 9/629 404/10 |
| 2015/0121733 | A1* | 5/2015 | Oberkofler | E01F 9/629 40/607.06 |
| 2017/0001094 | A1* | 1/2017 | Oh | A63C 19/08 |

FOREIGN PATENT DOCUMENTS

| | | | | |
|---|---|---|---|---|
| AT | 517609 | B1 * | 3/2017 | |
| EP | 1029985 | A2 * | 8/2000 | E01F 13/028 |
| GB | 2512623 | A | 10/2014 | |
| KR | 200390592 | Y1 * | 7/2005 | |
| KR | 20110089481 | A | 8/2011 | |
| KR | 20110097270 | A * | 8/2011 | |
| KR | 101673399 | B1 * | 11/2016 | |
| KR | 20180003005 | A * | 1/2018 | |
| KR | 101884192 | B1 * | 8/2018 | |

* cited by examiner

*Primary Examiner* — Theodore V Adamos
(74) *Attorney, Agent, or Firm* — Occhiuti & Rohlicek LLP

(57) ABSTRACT

A post assembly has a longitudinal axis extending from a proximal end to a distal end and includes a hollow outer shell, an anchoring sub-assembly disposed at the proximal end for securing the post assembly to a surface, a core assembly disposed within the hollow outer shell. The core assembly includes a core tube, a rigid rod having a lower end mechanically coupled to the anchoring sub-assembly and extending along the longitudinal axis to an upper end, and an elastic member disposed around the upper end of the rigid rod, the elastic member configured to transfer forces incident on the hollow outer shell through the elastic member to the anchoring sub-assembly via the rigid rod.

13 Claims, 9 Drawing Sheets

POST ASSEMBLY WITH IMPACT ABSORBING CORE MECHANISM

CROSS-REFERENCES TO RELATED APPLICATIONS

This application claims the benefit of U.S. Provisional Application No. 63/249,134 filed Sep. 28, 2021, the entire contents of which are incorporated herein by reference.

BACKGROUND

This invention relates to a post assembly having an impact absorbing mechanism core assembly.

Posts (including posts that hold signage) are known to be subject to crushing, deformation, disassembly, breakage, and destruction when struck by objects such as vehicles. The significant mass and velocity of the vehicles creates impacts of sufficient force to damage not only the post but also the surface the sign is mounted in, bystanders, and other objects including vehicles. Moreover, certain environments, such as parking lots or warehouses, subject posts to repeated, frequent impacts that can lead to deterioration of the posts over time.

SUMMARY

In some examples, when a customer is choosing a post assembly for installation on a surface, the customer needs to ensure that the post assembly provides the maximum safety to people and vehicles on the asphalt surface when it is struck and that the post assembly does not damage the surface when it is struck. For example, a post assembly should not be so flexible that it easily yields to the force of being struck by an object (e.g., vehicle) and is pushed into a vehicle or a person. The post assembly should also not be so rigid that it tears out of and damages the surface (e.g., asphalt tarmac or pavement) when it is struck by an object. Furthermore, the post assembly should be resistant to being damaged or destroyed when it is struck by an object.

In a general aspect, a post assembly has a longitudinal axis extending from a proximal end to a distal end and includes a hollow outer shell, an anchoring sub-assembly disposed at the proximal end for securing the post assembly to a surface, a core assembly disposed within the hollow outer shell. The core assembly includes a core tube, a rigid rod having a lower end mechanically coupled to the anchoring sub-assembly and extending along the longitudinal axis to an upper end, and an elastic member disposed around the upper end of the rigid rod, the elastic member configured to transfer forces incident on the hollow outer shell through the elastic member to the anchoring sub-assembly via the rigid rod.

Aspects may include one or more of the following features.

The core assembly may be disposed in the distal end of the post assembly. The core assembly may also include a first washer disposed in and affixed to the core tube, an a second washer positioned on the elastic member and coupled to the upper end of the rigid rod. The elastic member may be held between the first washer and the second washer.

Deflection of the post assembly may cause the second washer to move in a direction toward the first washer, causing compression of the elastic member. The anchoring sub-assembly may include an inclined surface configured to cause the post assembly to return to its original, undeflected position after deflection. The coupling of the second washer to the upper end may include an adjustment mechanism for changing a distance between the first washer and the second washer.

A lower end of the rigid rod may include a hook for attaching the rigid rod to the anchoring sub-assembly. The rigid rod may include a first portion extending along the longitudinal axis and a second portion extending along a second axis substantially parallel to and off the longitudinal axis. The elastic member may include a coil spring. The anchoring sub-assembly may include one or more fasteners for attaching the post assembly to the surface.

In another general aspect, a method for assembling a post assembly having a longitudinal axis extending from a proximal end to a distal end includes mechanically coupling a lower end of a rigid rod to an anchoring sub-assembly, positioning the rigid rod inside a core tube of a core assembly such that an upper end of the rigid rod extends through an opening in a first washer affixed inside the core tube, positioning an elastic member on the first washer with the upper end of the rigid rod extending therethrough, and positioning a second washer on the elastic member and affixing the second washer to the upper end of the rigid rod such that the elastic member is held between the first washer and the second washer.

Aspects may have one or more of the following advantages.

Unlike conventional post assemblies that are either unable to deflect without being damaged (e.g., a steel post stuck in the ground) or are too easily deflected (e.g., a post with a spring-like impact absorption mechanism), aspects described herein advantageously include a core assembly that can be configured to control deflection of the post assembly. As such, the post can be configured to deflect such that damage to the post, a vehicle, and a mounting surface avoided while also preventing over-deflection that would injure pedestrians.

Also, unlike conventional post assemblies that locate impact absorption mechanisms in a region where a vehicle might strike the post, aspects described herein advantageously move impact absorption mechanisms away from that region to prevent damaging components of the impact absorption mechanisms.

Other features and advantages of the invention are apparent from the following description, and from the claims.

DESCRIPTION

1 Overview

Figure 1:
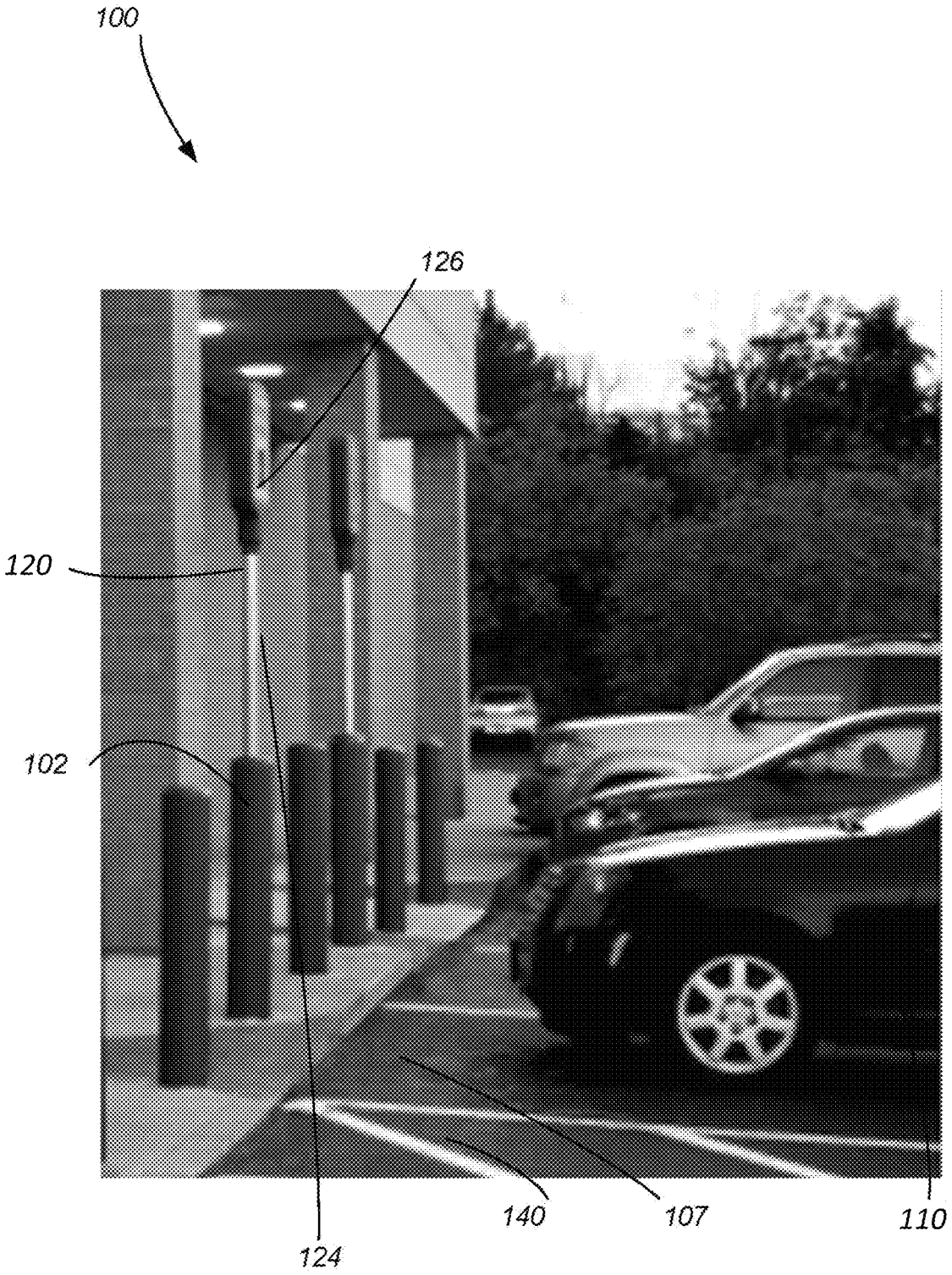
FIG. 1 is a view of flexible post assemblies positioned between a building and parking spaces.

Referring to FIG. 1, a post assembly 100 is positioned on a surface 140 (e.g., an asphalt surface of a parking lot) at the end of a nose-in parking space 107 in front of a retail store. The post assembly 100 is used as a protective barrier, for example, in parking lots having significant vehicle traffic. In particular, and as will be discussed in greater detail below, the post assembly 100 is configured to deflect upon impact by a vehicle 110, absorb those impact forces, and then return to its original, undeflected position. The ability of the post assembly 100 to bend minimizes damage to itself as well as to the surface 140.

Figure 2:
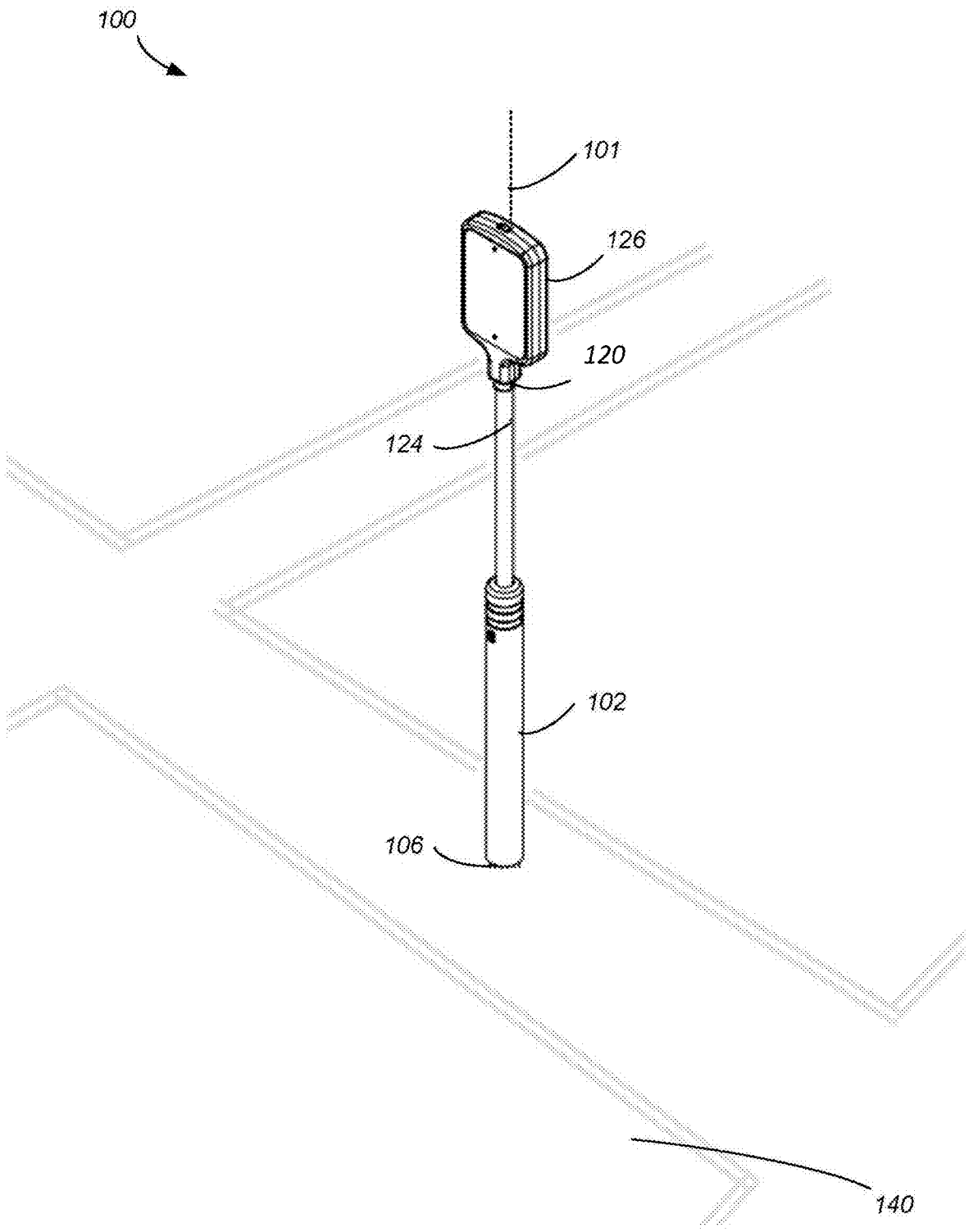
FIG. 2 is a perspective view of one of the flexible post assemblies shown in FIG.

Referring to FIGS. 1 and 2, post assembly 100 includes a post 124, which in this embodiment is in the form a metal tube extending from an upper end of an impact absorbing portion 102. A sign 126 (e.g., a "Handicapped Parking" sign) extends from a top end 120 of the post 124.

2 Impact Absorbing Portion

Figure 3:
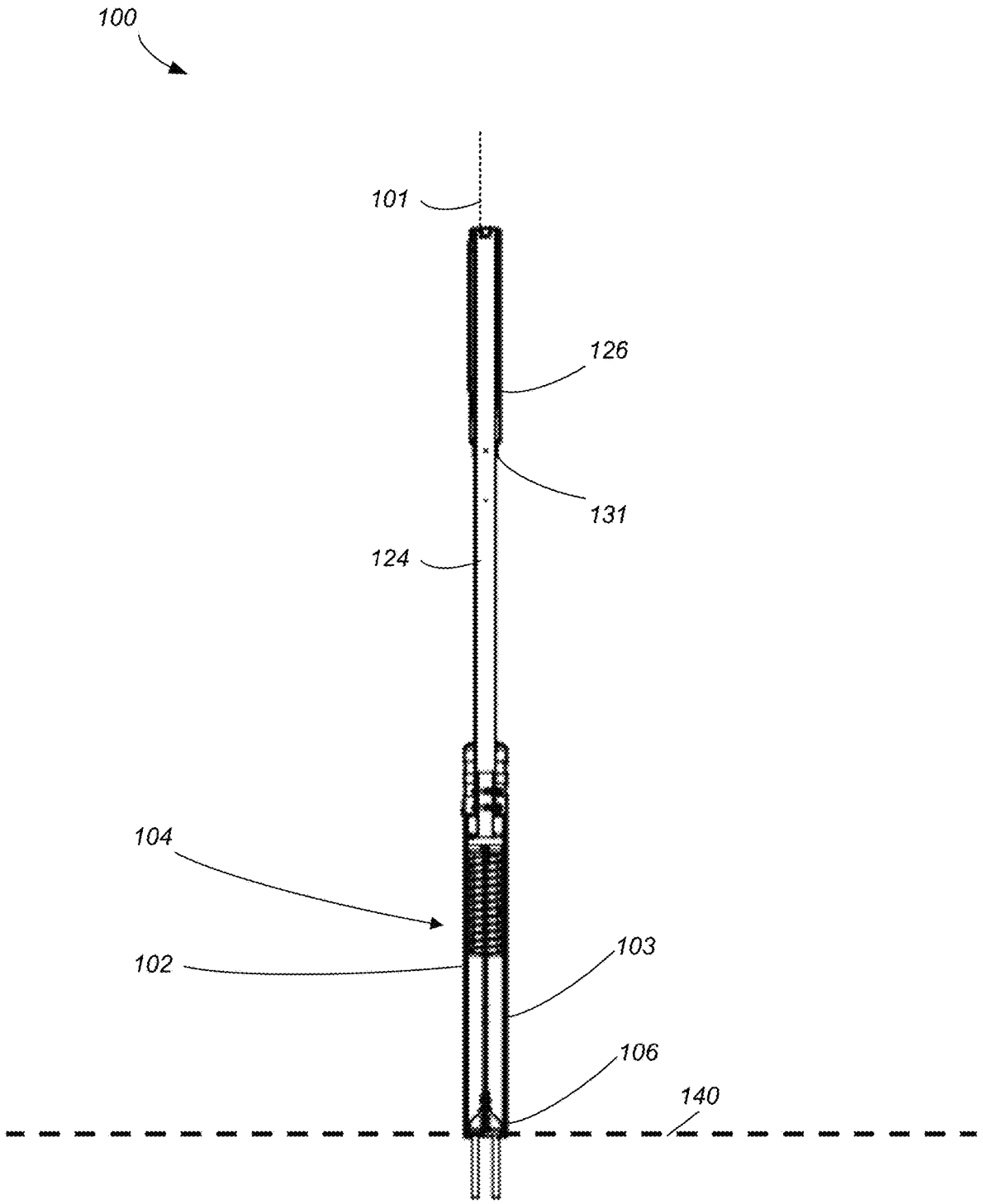
FIG. 3 is cross-sectional side view of the post assembly of FIG. 2.

Referring to FIGS. 2 and 3, the impact absorbing portion 102 of the post assembly 100 is disposed at a proximal end 106 of the post assembly 100, thereby occupying the region that the vehicle 110 is most likely to impact the post assembly 100.

As shown in FIG. 3, and will be described in greater detail below, the impact absorbing portion 102 includes a core assembly 104 and a surrounding hollow outer shell 103, both of which are aligned along a longitudinal axis 101 of the post assembly 100 in a substantially concentric configuration.

2.1 Hollow Outer Shell

In this example, the hollow outer shell 103 is a substantially tubular plastic (e.g., high-density polyethylene) structure that serves as an aesthetically pleasing, weather-resistant cover and provides a first impact absorbing feature for the impact absorbing portion 102 of the post assembly 100. As shown in FIG. 3, the hollow outer shell 103 covers the components and subassemblies of the core assembly 104, preventing these internal components from being tampered with, becoming damaged, or accumulating debris. The hollow outer shell 103 is sized and configured so as not to contact the impact absorbing portion 102 even when in a fully deflected position.

2.1 Core Assembly

Figure 4A:
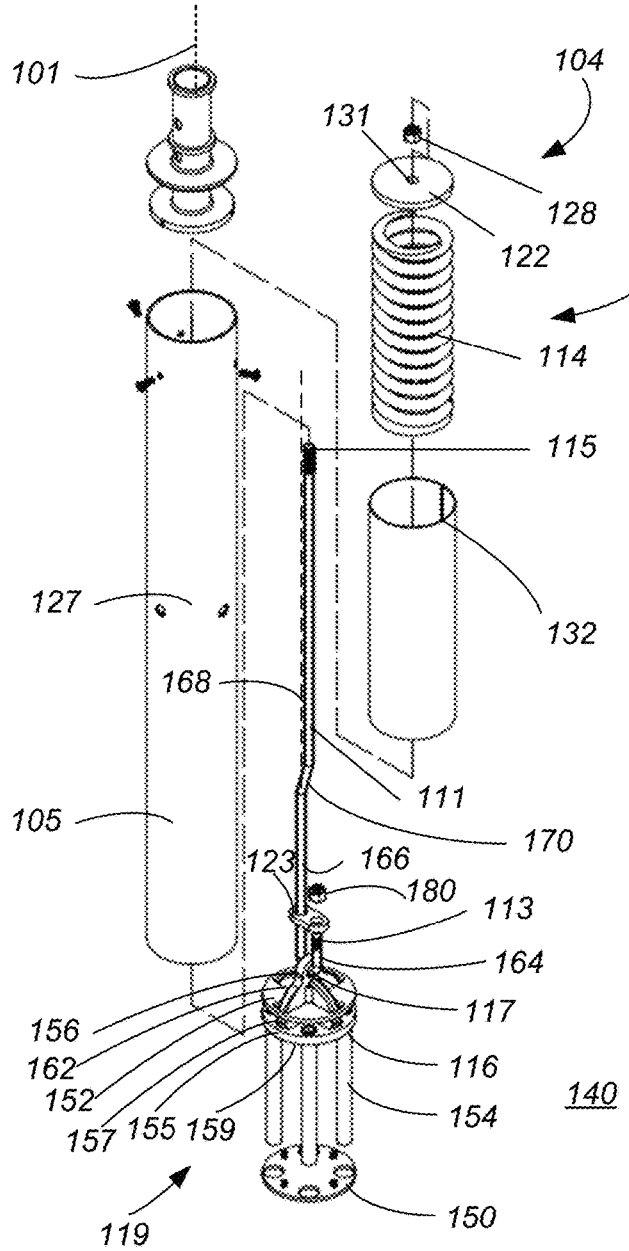
FIG. 4A is a partially exploded view of the post assembly of FIG. 2.
Figure 4B:
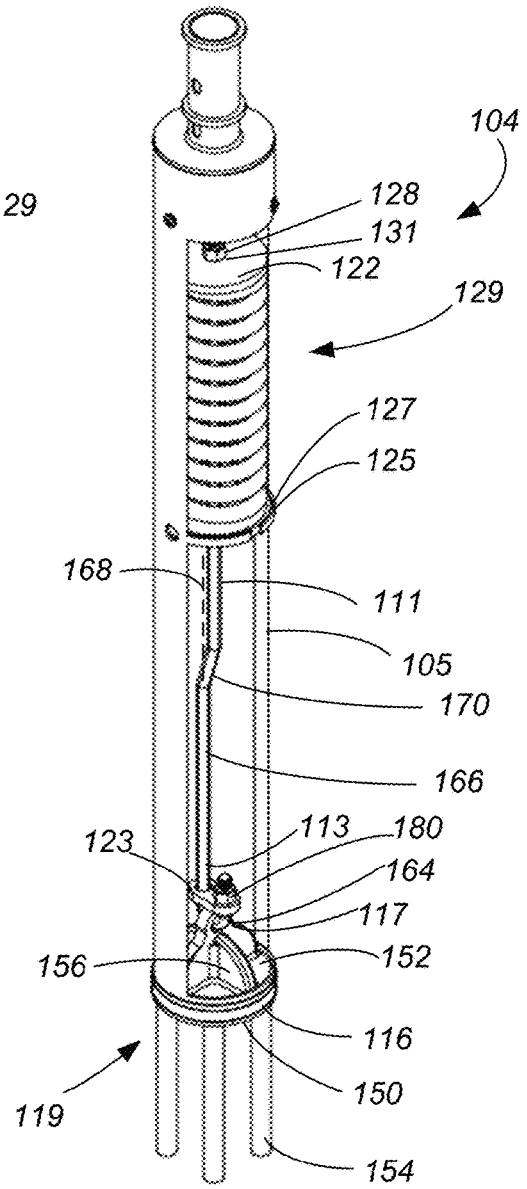
FIG. 4B is a view of the core assembly of the post assembly of FIG. 2.

Referring to FIGS. 4A and 4B, the core assembly 104 has a core tube 105 that surrounds an anchoring sub-assembly 119, a rigid rod 111, and an impact absorbing sub-assembly 129. The impact absorbing sub-assembly 129 is mechanically coupled to the anchoring sub-assembly 119 via the rigid rod 111. Specifically, a lower end 113 of the rigid rod 111 is connected to the anchoring sub-assembly 119 while an upper end 115 of the rigid rod is connected to the impact absorbing sub-assembly 129. The hollow outer shell 103 (not shown) is affixed to the core assembly 104.

As will be described in greater detail below, the core assembly 104 is capable of being adjusted and set to an appropriate magnitude of flexibility to protect against injury while reducing likelihood of removal from the surface 140 by maintaining a scope and range of flexibility but precisely controlling the points of rotation and adjustably controlling the forces required for flexing and rebound of post assembly 100 components.

2.1.1 Impact Absorbing Sub-Assembly

The impact absorbing sub-assembly 129 includes a spring 114 (e.g., a coil spring or other suitable elastic member), a free washer 122, and a fixed washer 125.

In general, the fixed washer 125 is fixed at a predetermined location 127 within the core tube 105. In some examples, the fixed washer 125 is welded (e.g., plug welded) to an interior surface of the core tube 105 at the predetermined location 127.

The spring 114 is dimensioned for insertion into the core tube 105 where it rests on the fixed washer 125. The free washer 122 rests on the spring 114 as a mounting plate and is dimensioned to ensure that it the free washer 122 cannot move into an interior space of the spring 114.

The upper end 115 of the rigid rod 111 extends through an opening (not shown) in the fixed washer 125, through the interior space of the spring 114, and through an opening 131 in the free washer 122. A nut 128 is threaded onto the upper end 115 of the rigid rod 111. The nut 128 and the opening 131 in the free washer 122 are dimensioned such that the nut 128 cannot move through the opening 131 in the free washer 122. This arrangement of elements results in the spring 114 being held captive between the fixed washer 125 and the free washer 122. When tension is applied to the rigid rod 111, the free washer 122 moves along the longitudinal axis 101, pressing the spring 114 against the fixed washer 125 to compress the spring 114.

In some examples, the spring 114 is disposed within a damper 132 that reduces noise generated by the spring 114 interacting with the core tube 105.

2.1.2 Anchoring Sub-Assembly

The anchoring sub-assembly 119 includes an anchor 116, an alignment plate 150, and a spacer plate 152.

The anchor 116 includes a base 155 with a top side 157 and a bottom side 159. A number of legs 154 (e.g., concrete or asphalt anchors) extend from the bottom side 159 of the base 155 and a number of arcuate ribs 156 supporting a loop 117 extend from the top side 157 of the base 155.

In general, the legs 154 are configured for insertion into the surface 140 to fasten the anchoring sub-assembly 119 to the surface 140. The arcuate ribs 156 securely attach the loop 117 to the base 155 and their acute shape promotes reseating of the core tube 105 after it deflects due to an impact (as is described in greater detail below).

The alignment plate 150 is configured to rest on the surface 140 and includes a number of through holes 160 through which the legs 154 of the anchor 116 extend into the surface 140. In some examples, the alignment plate 150 is used as a guide for drilling holes into the surface for accommodating the legs 154.

The spacer plate 152 includes an opening 162 sized and shaped to allow the arcuate ribs 156 to pass through the spacer plate 152, with the spacer plate 152 resting on the top side 157 of the base 155.

The lower end 113 of the rigid rod 111 includes a hook 164 that extends through the loop 117 in a way that mechanically couples the rigid rod 111 to the anchor 116 while allowing the rigid rod 111 to rotate freely about the connection point between the rigid rod 111 and the loop 117.

2.1.2.1 Rigid Rod

As mentioned above, the lower end 113 of the rigid rod 111 includes a hook 164 that is mechanically coupled, via loop 117, to the anchor 116 of the rotation assembly 130.

Lower end 113 is threaded to receive a nut 180 after the hook 164 is passed through loop 117. As will be described in greater detail below in conjunction with FIG. 7, the hook 164 facilitates the assembly of the impact absorbing sub-assembly 129.

Although the hook 164 is easily attached to anchor 116, this attachment approach creates a small misalignment of the lower end 113 and upper end 115 of the rigid rod 111 relative to the anchoring sub-assembly 119 and impact absorbing sub-assembly 129, respectively. For this reason, rigid rod 111 includes an offset length 166 extending along an axis 168 that is offset from but parallel to longitudinal axis 101. The offset length 166 creates an angled transition 170 between an upper portion to a lower portion of the rigid rod 111. In this embodiment, offset length 166 extends from a point below the midpoint of the rigid rod to its lower end 113.

The offset length 166 ensures that the points of contact of hook 164 at the anchoring sub-assembly 119 and the impact absorbing sub-assembly 129 both lie on longitudinal axis 101.

2.1.2.2 Operation of Core Assembly

Figure 5B:
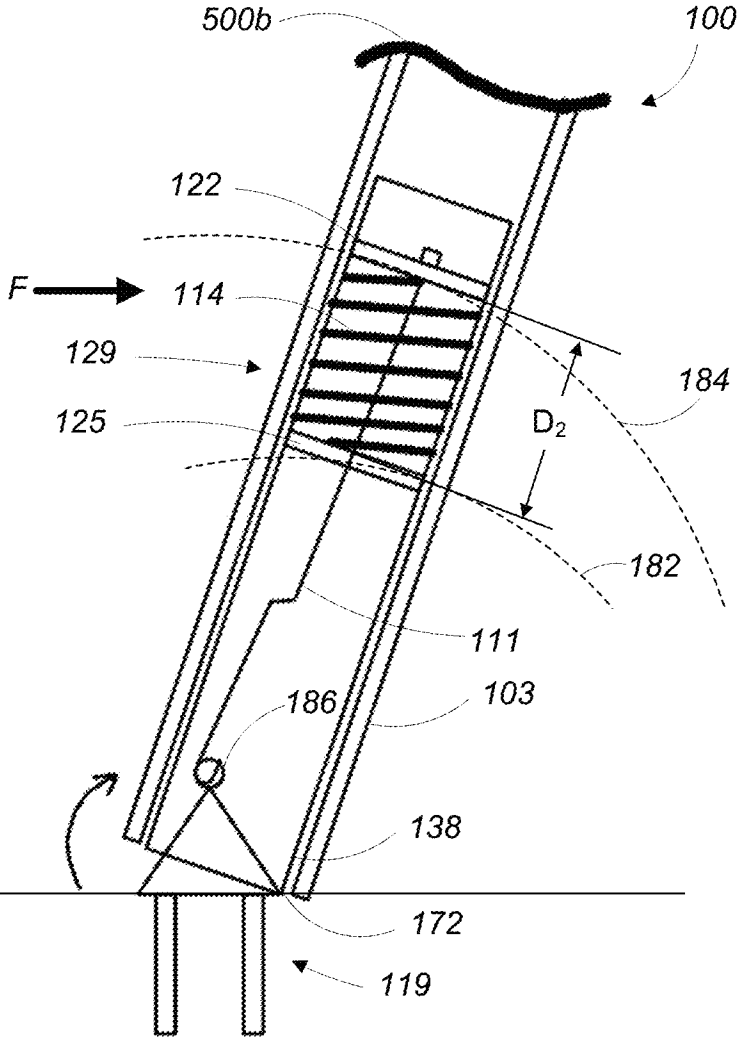
FIG. 5B shows the post assembly of FIG. 2 in its deflected position.
Figure 5A:
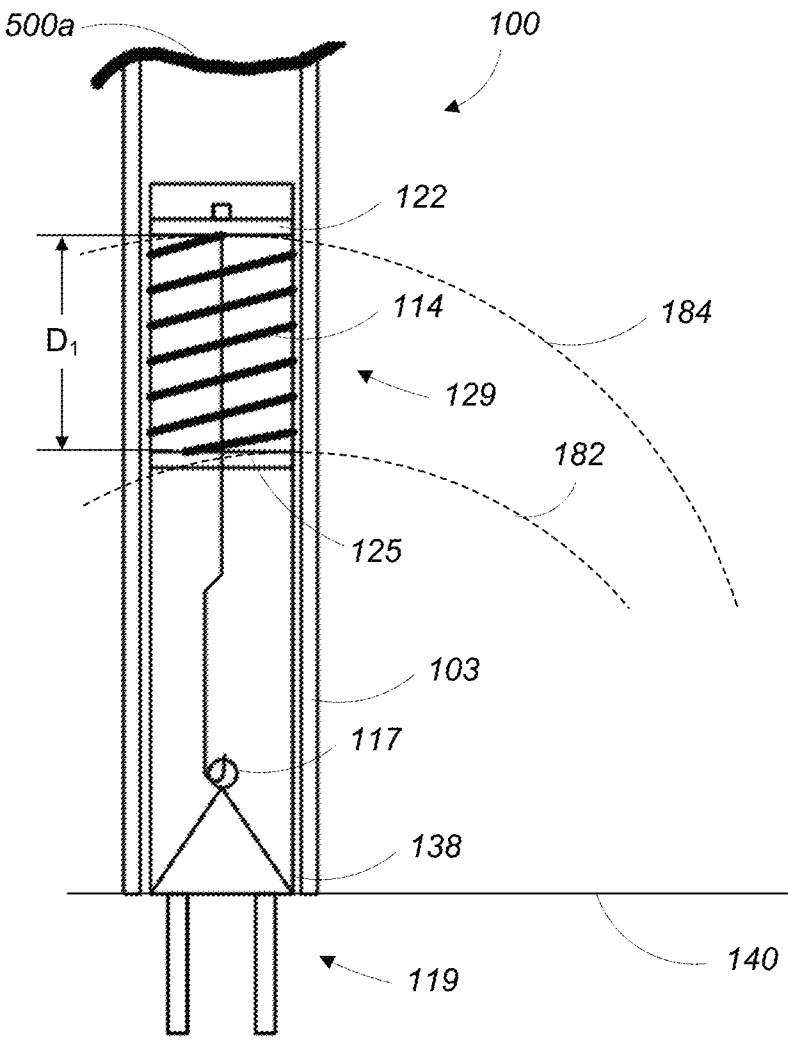
FIG. 5A shows the post assembly of FIG. 2 in its stationary.

Referring to FIGS. 5A and 5B, the post assembly 100 is shown in an undeflected position 500*a* (in FIG. 5A) and a deflected position 500*b* (in FIG. 5B). When in the undeflected position 500*a* shown in FIG. 5A, the post assembly 100 stands upright. The spring 114 of the impact-absorbing sub-assembly 129 is held with a first degree of compression between the free washer 122 and the fixed washer 125 of the impact-absorbing sub-assembly 129. The first compression corresponds to a distance, $D_1$ between the free washer 122 and the fixed washer 125 when the post assembly is in the undeflected position 500*a*.

As shown in FIG. 5B, when an object strikes the post assembly 100, it applies a force, F to the post assembly and causes the post assembly 100 to move to the deflected position 500*b*. When the post assembly 100 deflects to the deflected position 500*b*, the core tube 105 of the core assembly 129 is deflected away from the force of impact. An edge of the bottom end 138 of the core tube 105 contacts the surface 140 (or a part of the anchoring sub-assembly 119) at a point opposite the force of impact and forms a pivot point 172. The fixed washer 125 of the impact absorbing sub-assembly rotates in a first circular path 182 about the pivot point.

The anchoring sub-assembly 119, however remains fixed in the surface 140 and does not rotate around the pivot point 172. The free washer 122 is coupled to the loop 117 of the anchoring sub-assembly 119 using the rigid rod 111. The free washer 122 therefore rotates in a second circular path 184 about the connection point 186 between the rigid rod 111 and the loop.

Because of the relative positions of the pivot point 172 and the connection point 186, the first circular path 182 and the second circular path 184 each have a different radius and converge as the post assembly 100 deflects from the undeflected position 500*a* to the deflected position 500*b*. As a result of the circular paths converging, the free washer 122 and the fixed washer 125 (which follow the first circular path 182 and the second circular path 184, respectively) converge. In the deflected position 500*b*, the free washer 122 and the fixed washer 125 have converged and a distance between the fixed washers 125, 122 is $D_2$. The distance $D_2$ is less than $D_1$, so the spring 114 is compressed to a second degree of compression, greater than the first degree of compression, in the second position 500*b*.

When the force, F is removed, the spring 114 decompresses, causing the distance between the washers 122, 125 to return to $D_1$. As the distance between the washers 122, 125 increases from $D_2$ to $D_1$, the washers 122, 125 move along their respective circular paths 182, 184 as the post assembly 100 returns to the undeflected position 500*a*.

In some examples, the anchoring sub-assembly 119 includes a structure (e.g., the arcuate ribs 156 of FIGS. 4A and 4B) that guide the core tube 105 back to its original position in the undeflected position 500*a*, ensuring that the post assembly 100 successfully reseats after impact.

In this example, the post assembly 100 is designed to deflect up to 90 degrees from the initial set position of the longitudinal axis 101 (which generally may be aligned substantially vertically and perpendicular to the surface 140) to a position approximately parallel to the surface 140. The post assembly 100 is designed to deflect 360 degrees (of azimuthal and radial travel) around the longitudinal axis 101 without becoming damaged.

The spring 114 is positioned such that during its engagement it remains outside of the likely zone of impact (e.g., above where a vehicle 110 bumper would strike the core tube 105).

2.1.2.3 Core Assembly Adjustability

Figure 6B:
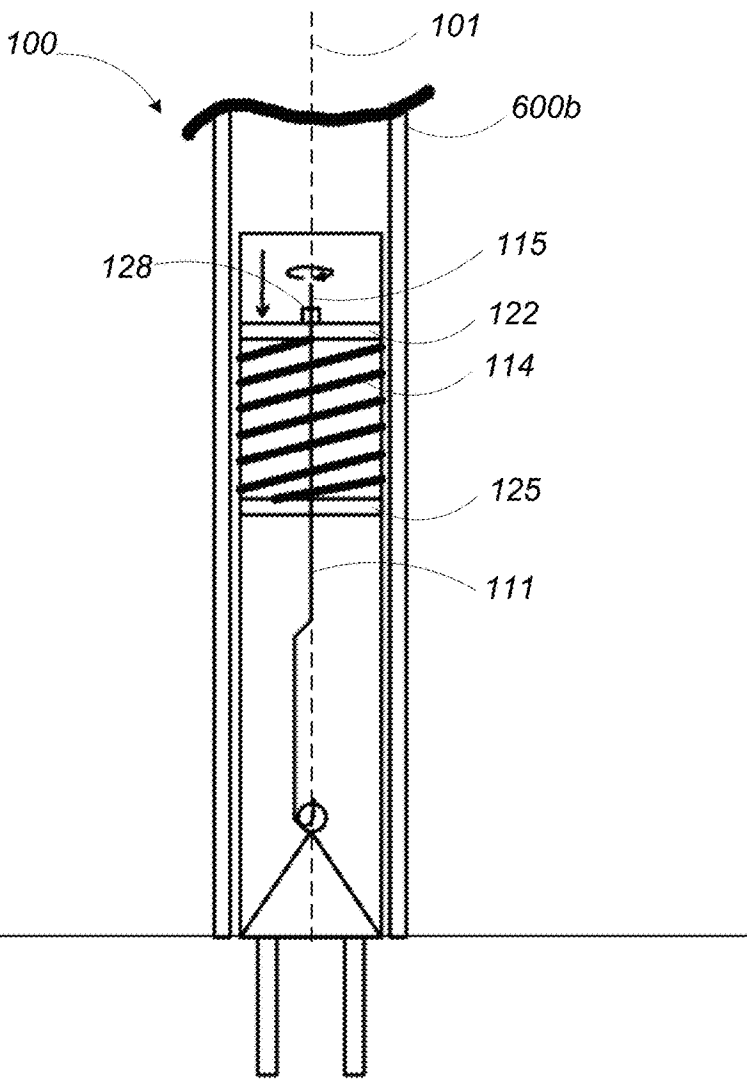
FIG. 6B is cross-sectional view of the subcomponents of the post assembly of FIG. 6A with adjustment nut height in a compressed configuration.
Figure 6A:
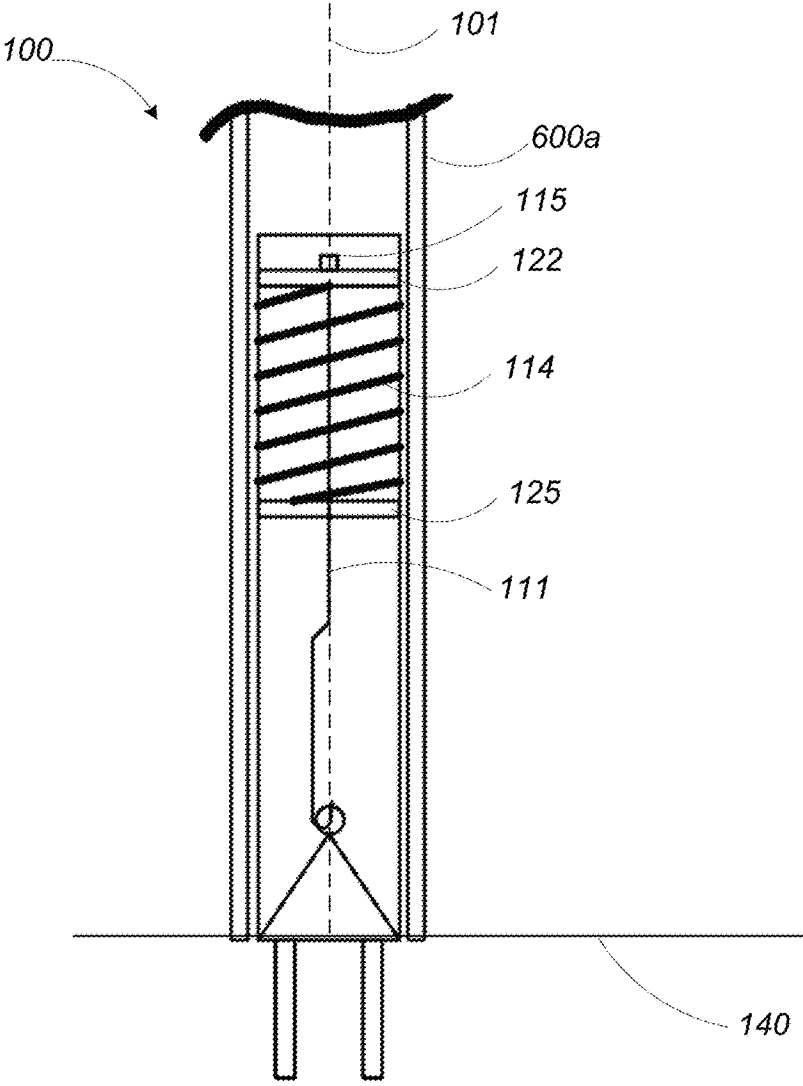
FIG. 6A is cross-sectional view of the hollow outer shell, inner core assembly elastic member, washer, and adjustment nut of the post assembly.

Referring to FIGS. 6A and 6B, in some examples, the degree of compression of the spring 114 is adjustable. For example, in a first configuration 600*a*, the spring 114 is held between the free washer 122 and the fixed washer 125 at a first degree of compression.

In the second configuration 600*b*, the degree of compression has been increased by twisting the nut 128 (e.g., in a clockwise direction) to advance the nut along the upper end 115 of the rigid rod 111. As the nut 128 advances, the free washer 122 is moved along the longitudinal axis 101 in a direction toward the surface 140, further compressing the spring against the fixed washer 125. It should be appreciated that the compression of the spring 114 can be decreased by retreating the nut 128 along the upper end 115 of the rigid rod 111.

2.1.2.4 Method of Assembly and Installation

Figure 7:
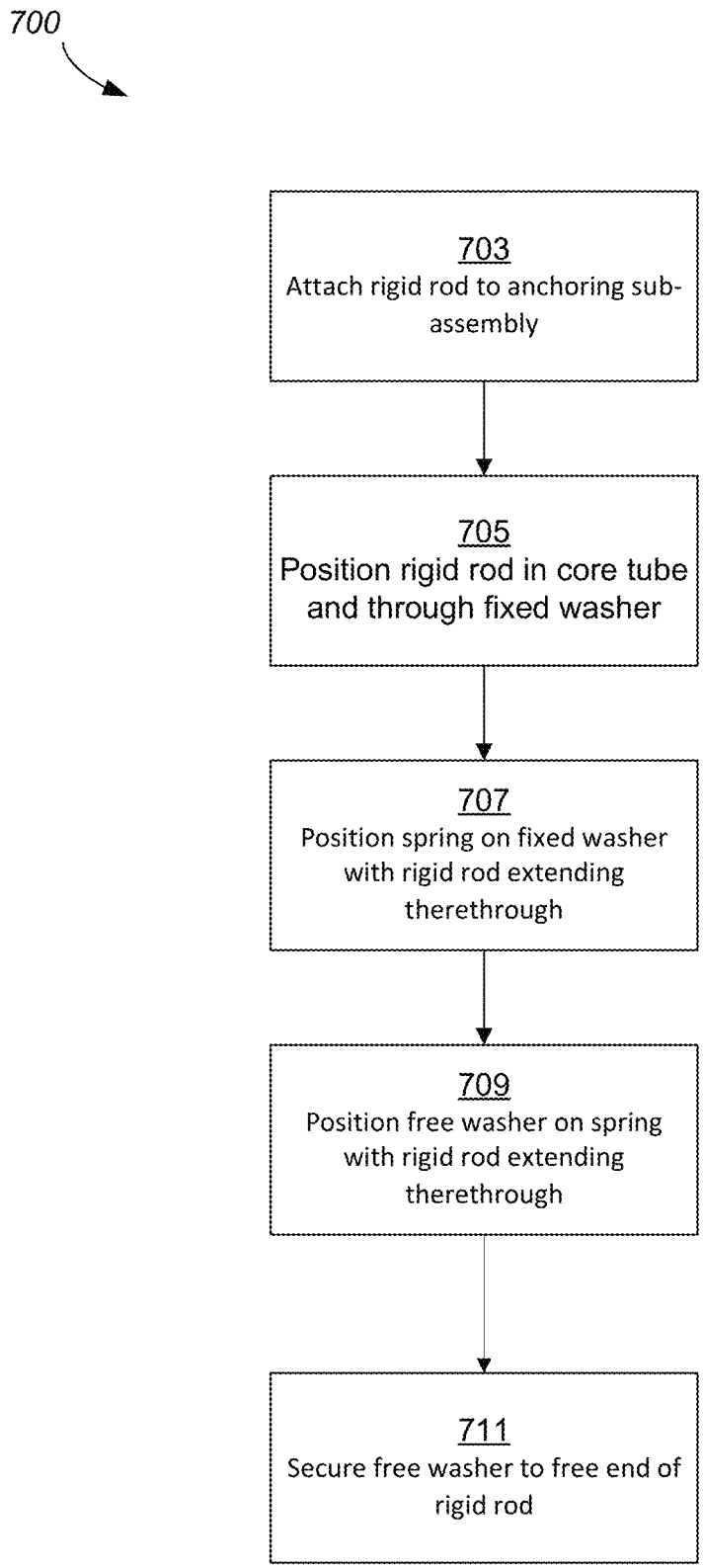
FIG. 7 is a flowchart depicting a method of assembling a post assembly.

Referring to FIG. 7, a flow chart depicts a method 700 for assembling the post assembly 100.

In a first step 703 of the method 700, the rigid rod 111 is attached to the anchoring sub-assembly 119 by inserting the hook 164 of the rigid rod 111 through the loop 117 of the anchoring sub-assembly 119. In some examples, the hook 164 is secured in the loop 117 using a cuff (see FIG. 4A, element 123) that closes the hook 164 around part of the loop 117. The cuff 123 may be held in place by the nut 180.

In a second step 705, the rigid rod 111 is inserted into the core tube 105 from the bottom end 138. Once inserted, the rigid rod 111 extends in a direction away from the bottom end 138 and through an opening in the fixed washer 125.

In a third step 707, the spring 114 is inserted into the core tube 105 and positioned such that it rests on the fixed washer 125 with the upper end 115 of the rigid rod 111 extending therethrough.

In a fourth step 709, the free washer 122 is positioned on the spring 114 with the upper end 115 of the rigid rod 111 extending through the opening 131 in the free washer 122.

In a fifth step 711, the nut 128 is screwed onto threads on the upper end 115 of the rigid rod 111, securing the spring 114 between the free washer 122 and the fixed washer 125. In some examples, the extent to which the nut 128 is screwed onto the upper end 115 of the rigid rod 111 determines a degree of compression of the spring 114.

3 Light-Up Post Assembly

Figure 8:
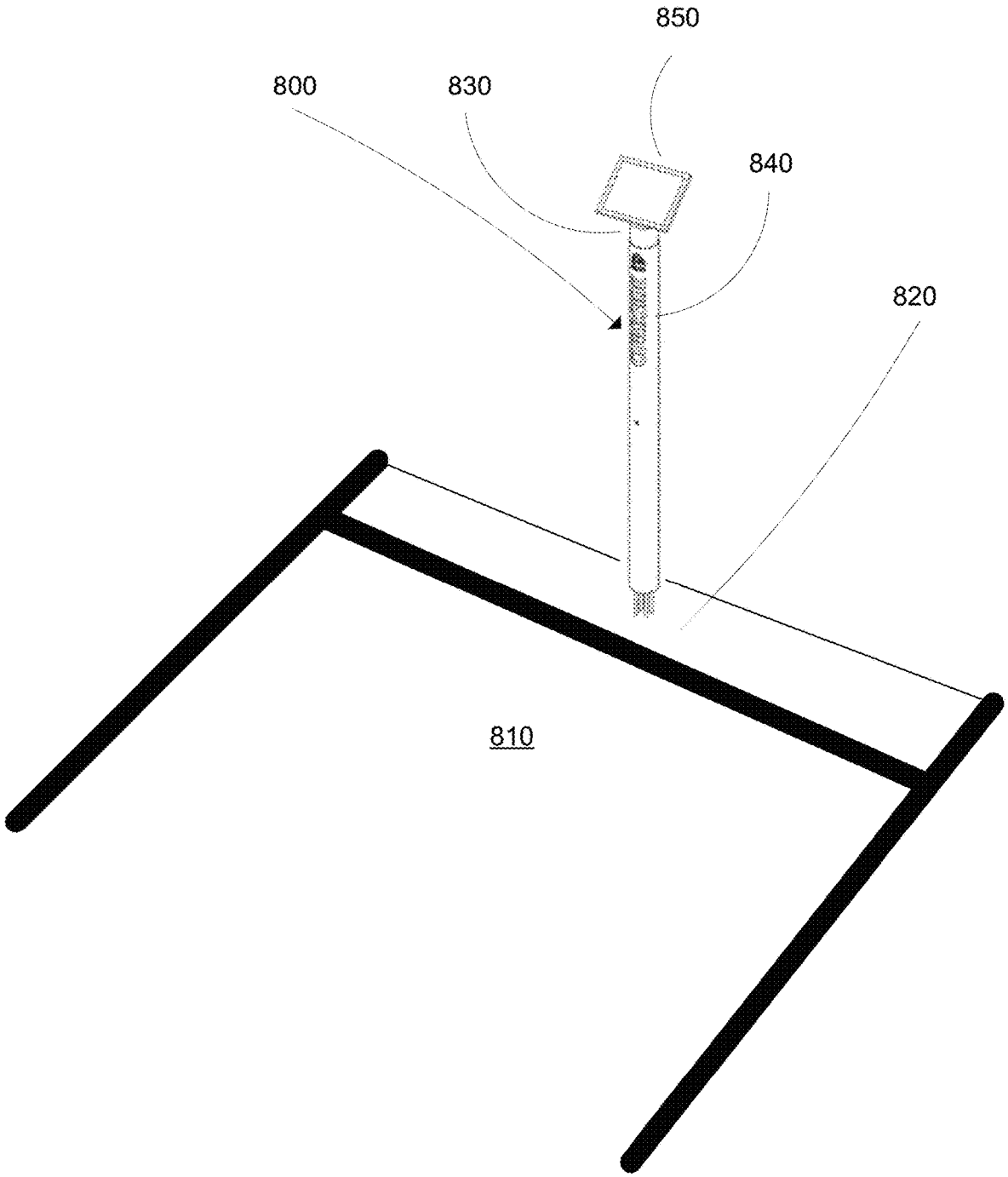
FIG. 8 is a view of a post assembly with a light-up top.

Referring to FIG. 8, a light-up post assembly 800 is positioned on a surface 810 (e.g., an asphalt surface of a parking lot) at the end of a nose-in parking space 820. The light-up post assembly 800 functions similarly to the post assembly 100 in FIG. 1, however the light-up post assembly 800 provides added functionality. In particular, the light-up post assembly 800 includes a lighting core assembly 910 (not pictured, and described in further detail below), which in turn includes a light-emitting assembly 830 visible at the upper end of the light-up post assembly 800. The light-emitting assembly 830 illuminates the area (e.g., parking area or bus stop) around the light-up post assembly 800 to improve visibility and safety for passersby in dark conditions.

In this embodiment, a text 840 extends down the length of the light post assembly and, when necessary, can be illuminated by the light-emitting assembly 830. The text 840 can include words, numbers, symbols or other indicia for multiple purposes, including, e.g., displaying lot-owner branding, advertisements for business(es), and/or informational materials. A solar panel 850 provides power for the light-emitting assembly 830.

Figure 9:
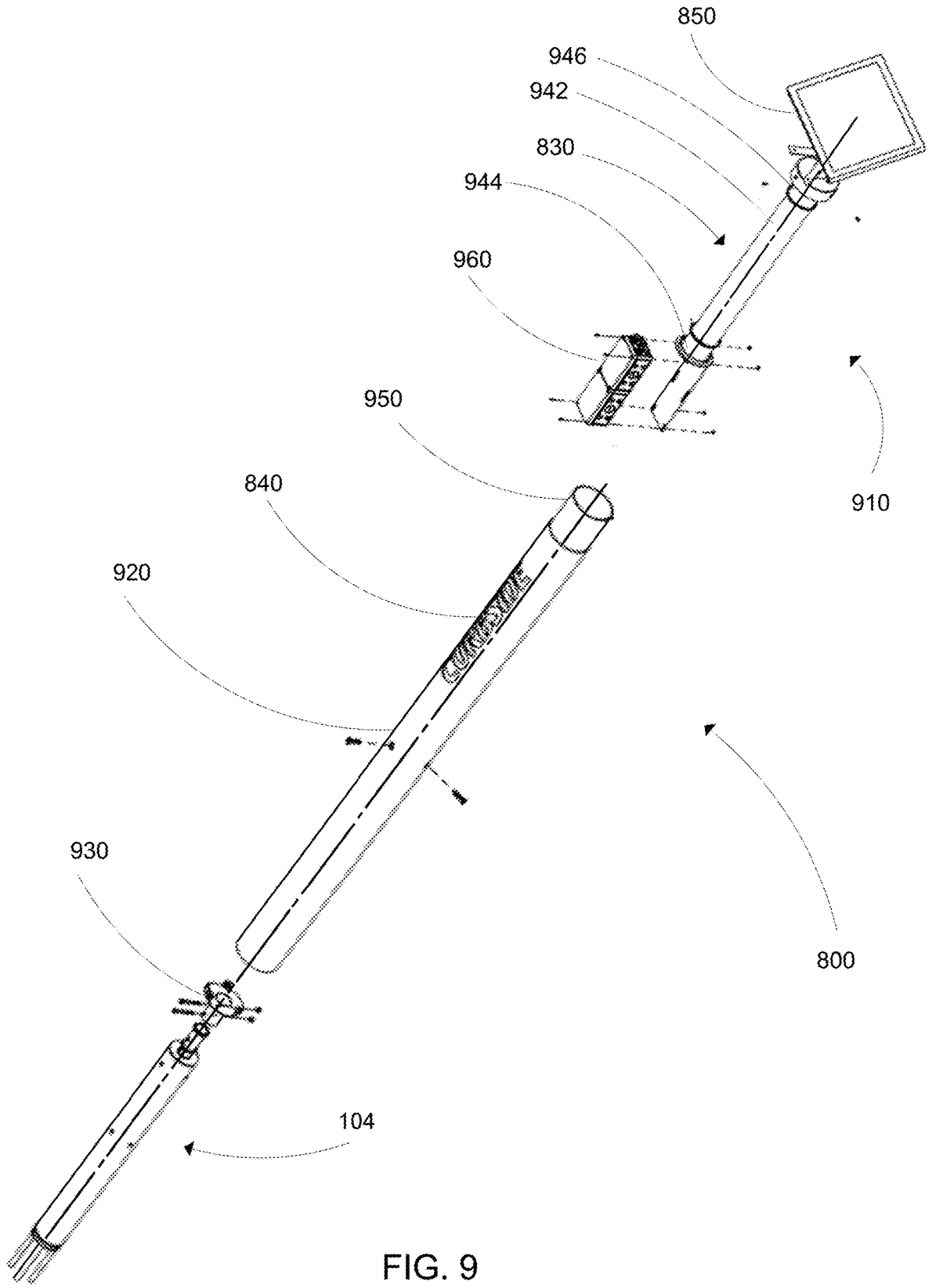
FIG. 9 is a partially exploded view of the post assembly of FIG. 8.

Referring to FIG. 9, the light-up post assembly 800 includes the lighting core assembly 910 and the core assembly 104 (see FIGS. 4A and 4B). The lighting core assembly includes the light-emitting assembly 830, the solar panel 850, and an electrical power supply 960. An outer shell 920 encloses the lighting core assembly 910 of the light-up post assembly 800 as well as the core assembly 104, which attaches to the outer shell 920 via a coupling 930. Thus, as is the case shown in FIG. 9, when the functionality of the post assembly 100 shown in FIGS. 1-6 is combined with the functionality of the light post assembly 800, the outer shell 920 encloses both assemblies.

The lighting core assembly 910 includes the light-emitting assembly 830 in the form of a tube 942 with a light 944 and a light 946 positioned at both ends of the tube. The light-emitting assembly 830 may be placed within a light-diffusing tube 950 (formed of, e.g., an acrylic material), which is inserted within the outer shell 920. In this example, the light-diffusing tube 950 is partially exposed at the top of the outer shell 920, which permits the top of the light-emitting assembly 830 to function as a lamp. In this embodiment, insertion of the light-emitting assembly 830 within the light-diffusing tube 950 permits the light-emitting assembly 830 to illuminate the text 840 when appropriate (e.g., at night or times of low visibility).

The lighting core assembly 910 further includes the solar panel 850 powered by the electrical power supply 960. The electrical power supply 960 includes a battery and, in this embodiment, a controller, and the electrical power supply 960 is electronically coupled to the solar panel 850 and the light-emitting assembly 830. The electrical power supply 960 can thereby store electricity derived from the solar panel 850 and use said electricity to power the light-emitting assembly 830. Such functionality permits operation of the light-emitting assembly 830 even with an absence of sunlight to power the solar panel 850 at the time of operation (e.g., at night or times of low visibility).

In some embodiments, the lights 944 and 946 may each be comprised of one or more light-emitting diodes ("LEDs") as the source of light. In other embodiments, the light-emitting assembly 830 may derive power from means other than a solar panel (e.g., a battery or an electrical line). In such embodiments, the solar panel 850 and/or the electrical power supply 960 may not be present and/or necessary for potentially desired functionality.

3 Alternatives

While the examples above are described in the context of a post assembly for holding signage, it is important to appreciate that the function of the core assembly 104 is not limited to sign-holding applications. For example, the core assembly 104 may be used in bollard applications or in other types of posts such as fenceposts.

In general, certain components of the post assembly are fastened together using fasteners 118 which are positioned through holes in the components. Appropriate fasteners may include screws, bolts, or rivets as well as washers and nuts as required to complete a fastener set. In other embodiments the components may be attached with fasteners in the form of adhesives or welds.

In some examples: the core tube 105 has a length in the range of 16 inches to 86 inches or more, where 16 inches is a lowest impact point from a standard vehicle bumper; a distance from the surface on which the core tube 105 rests to the bottom surface of the sign 126 is approximately 60 inches.

The embodiments described above use a spring 114 (e.g., a coil spring) as part of the impact absorbing sub-assembly 129. Other forms of resilient devices can be used as an elastic member in place of the spring 114 including, for example, spring-like or elastic members formed of elastomeric materials (e.g., rubber).

It is to be understood that the foregoing description is intended to illustrate and not to limit the scope of the invention, which is defined by the scope of the appended claims. Other embodiments are within the scope of the following claims. A number of embodiments of the invention have been described. Nevertheless, it is to be understood that the foregoing description is intended to illustrate and not to limit the scope of the invention, which is defined by the scope of the following claims. The use of any reference characters/signed enclosed in parentheses relating to features in the claims is to be considered as having no effect on the scope of the claims. Accordingly, other embodiments are also within the scope of the following claims. For example, various modifications may be made without departing from the scope of the invention. Additionally, some of the steps described above may be order independent, and thus can be performed in an order different from that described.

What is claimed is:

1. A post assembly having a longitudinal axis extending from a proximal end to a distal end, the post assembly comprising:

a hollow outer shell;

an anchoring sub-assembly disposed at the proximal end for securing the post assembly to a surface;

a core assembly disposed within the hollow outer shell, the core assembly including:

a core tube;

a rigid rod having a lower end pivotably coupled to the anchoring sub-assembly and extending along the longitudinal axis to an upper end disposed in the distal end of the post assembly; and an elastic member disposed in the distal end of the post assembly and around the upper end of the rigid rod, the elastic member configured to transfer forces incident on the hollow outer shell through the elastic member to the anchoring sub-assembly via the rigid rod;

wherein the elastic member of the core assembly is disposed at a predetermined distance from the surface and outside a region of the post assembly where impacts to the post assembly are likely to occur.

2. The post assembly of claim 1 wherein the core assembly further includes:

a first washer disposed in and affixed to the core tube, and a second washer positioned on the elastic member and coupled to the upper end of the rigid rod, wherein the elastic member is held between the first washer and the second washer.

3. The post assembly of claim 2 wherein deflection of the post assembly causes the second washer to move in a direction toward the first washer, causing compression of the elastic member.

4. The post assembly of claim 2 wherein the anchoring sub-assembly includes an inclined surface configured to cause the post assembly to return to return to an original, undeflected position of the post assembly after deflection.

5. The post assembly of claim 2 further comprising an adjustment mechanism for changing a distance between the first washer and the second washer, wherein the adjustment mechanism couples the second washer to the upper end.

6. The post assembly of claim 2 wherein deflection of the post assembly causes the first washer to rotate about a pivot point where the core tube contacts the surface and the second washer; and causes the second washer to rotate about a point where the lower end of the rigid rod is coupled to the anchoring sub-assembly.

7. The post assembly of claim 1 wherein a lower end of the rigid rod includes a hook for attaching the rigid rod to the anchoring sub-assembly.

8. The post assembly of claim 1 wherein the rigid rod includes a first portion extending along the longitudinal axis and a second portion extending along a second axis substantially parallel to and off the longitudinal axis.

9. The post assembly of claim 1 wherein the elastic member includes a coil spring.

10. The post assembly of claim 1 wherein the anchoring sub-assembly includes one or more fasteners for attaching the post assembly to the surface.

11. The post assembly of claim 1 wherein the rigid rod includes:

a lower portion extending from the lower end of the rigid rod to a transition portion of the rigid rod, and an upper portion extending from the transition portion of the rigid rod to the upper end of the rigid rod, wherein the lower portion extends along the longitudinal axis and the upper portion extends along a second axis substantially parallel to and off the longitudinal axis.

12. The post assembly of claim 1 wherein the core assembly further includes a noise reducing damper housing the elastic member.

13. A method for assembling a post assembly having a longitudinal axis extending from a proximal end to a distal end, the method comprising:

pivotably coupling a lower end of a rigid rod to an anchoring sub-assembly;

positioning the rigid rod inside a core tube of a core assembly such that an upper end of the rigid rod extends through an opening in a first washer affixed inside the core tube and is disposed in the distal end of the post assembly;

positioning an elastic member in the distal end of the post assembly and on the first washer with the upper end of the rigid rod extending therethrough; and positioning a second washer on the elastic member and affixing the second washer to the upper end of the rigid rod such that the elastic member is held between the first washer and the second washer;

wherein the elastic member is disposed at a predetermined distance from the proximal end of the post assembly and outside a region of the post assembly where impacts to the post assembly are likely to occur.

* * * * *